United States Patent [19]

Harwath

[11] Patent Number: 4,685,871

[45] Date of Patent: Aug. 11, 1987

[54] GEAR PUMP WITH MEANS FOR PREVENTING SHAFT LOCK-UP

[75] Inventor: Frank L. Harwath, Rockford, Ill.

[73] Assignee: Suntec Industries Incorporated, Rockford, Ill.

[21] Appl. No.: 902,939

[22] Filed: Sep. 2, 1986

[51] Int. Cl.[4] ..... F04C 18/08; F16B 3/00; F16D 1/00

[52] U.S. Cl. ..... 418/206; 403/354; 403/356; 403/11

[58] Field of Search ..... 418/206; 403/11, 318, 403/354, 356

[56] References Cited

U.S. PATENT DOCUMENTS

| | | | |
|---|---|---|---|
| 1,925,788 | 9/1933 | Carter | 403/354 |
| 2,482,229 | 9/1949 | Weaver | 403/354 |
| 2,666,394 | 1/1954 | Sadler | 403/356 |
| 3,172,294 | 3/1965 | Stuhler | 403/354 |
| 3,654,581 | 4/1972 | Franz | 403/354 |
| 4,171,939 | 10/1979 | Harwath | 418/170 |
| 4,290,711 | 9/1981 | Paine et al. | 403/318 |
| 4,391,580 | 7/1983 | Hunsberger et al. | 431/1 |
| 4,586,845 | 5/1986 | Morris | 403/354 |

*Primary Examiner*—Carlton R. Croyle
*Assistant Examiner*—Jane R. Obee
*Attorney, Agent, or Firm*—Leydig, Voit & Mayer

[57] ABSTRACT

The pinion gear of a gear pump is press fit onto the end portion of the drive shaft of the pump and is positively captivated on the shaft by a key and by a hot upsetting process, the latter resulting in the formation of axially protruding burrs on the end face of the shaft. When the drive shaft is rammed forwardly with significant force, the burrs tend to embed in an end plate disposed in opposing relation with the shaft. To prevent the burrs from embedding in the end plate and locking the shaft against rotation, the end plate is formed with a recess which receives the burrs with substantial axial clearance when the shaft is rammed forwardly against the end plate.

3 Claims, 5 Drawing Figures

GEAR PUMP WITH MEANS FOR PREVENTING SHAFT LOCK-UP

BACKGROUND OF THE INVENTION

This invention relates generally to a gear pump and, more particularly, to a gear pump which is especially adapted to supply pressurized liquid fuel to an oil burner. Gear pumps of this general type are disclosed in Harwath U.S. Pat. No. 4,171,939 and Hunsberger et al U.S. Pat. No. 4,391,580.

In such a gear pump, it is conventional for a pinion gear to be secured by a key to the free end portion of a rotatable drive shaft having a free end which normally is disposed in spaced opposing relation with an end plate. Also, it is conventional to stake the key in the shaft by deforming the metal of the free end of the shaft with a hot upsetting operation. As a result of the upsetting operation, burrs protrude axially from the free end of the shaft.

Under abnormal conditions, the drive shaft may be rammed toward the end plate with sufficient force to cause the burrs to embed in the end plate. If this occurs, the shaft may lock up and render the pump useless.

SUMMARY OF THE INVENTION

The general aim of the present invention is to provide a new and improved gear pump in which the problem created by burrs embedding in the end plate is eliminated in an extremely simple and economical manner without need of adding any parts to the pump and without incurring the expense of removing the burrs from the shaft.

A more detailed object is to achieve the foregoing by forming a recess in the end plate in spaced opposing relation with the center portion of the end face of the shaft. When the shaft is rammed toward the end plate, the smooth outer peripheral portion of the end face of the shaft engages and stops against the end plate while the burrs at the center portion of the shaft simply enter into the recess and remain out of contact with the end plate. In this way, the burrs are prevented from embedding in the end plate and causing freezing of the shaft.

These and other objects and advantages of the invention will become more apparent from the following detailed description when taken in conjunction with the accompanying drawings.

DETAILED DESCRIPTION OF THE PREFERRED EMBODIMENT

Figure 1:
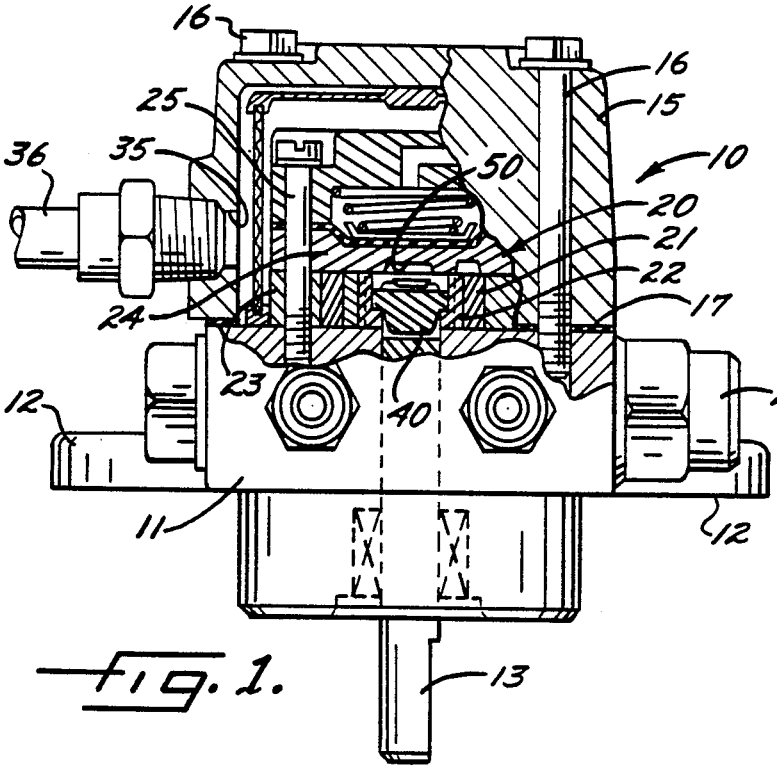
FIG. 1 is a side elevational view of a new and improved gear pump incorporating the unique features of the present invention, certain parts of the pump being broken away and shown in section.
Figure 2:
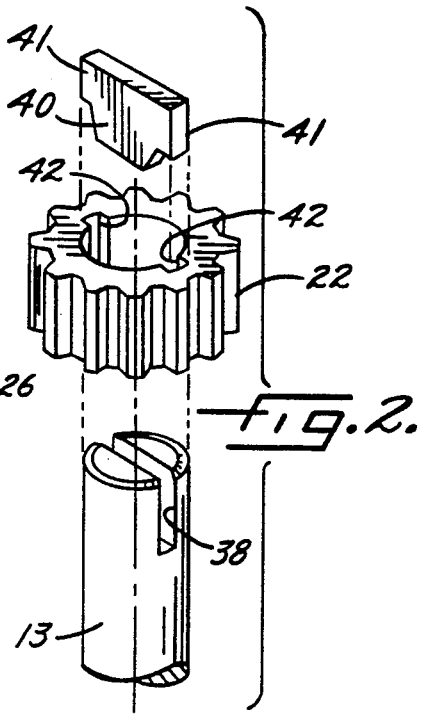
FIG. 2 is an exploded perspective view of the pump shaft, the pinion gear and the key.

For purposes of illustration, the invention has been shown in the drawings as embodied in a gear pump 10 of the type which is widely used for delivering fuel oil from a tank (not shown) and supplying the fuel under pressure to an oil burner (not shown). The constructional and operational features of the pump from a hydraulic standpoint are substantially identical to those of the pump disclosed in Hunsberger et al U.S. Pat. No. 4,391,580 to which reference is made for a detailed explanation of the hydraulic structure and operation of the pump.

Briefly, the pump 10 includes a body comprising a first member 11 formed by a casting having ears 12 for mounting the pump. A drive shaft 13 extends through the casting 11 and is rotatably supported in the casting. The outer end portion of the shaft projects outwardly from the outer end of the casting and is adapted to be connected to a drive motor (not shown).

Disposed in face-to-face relation with the other end of the casting 11 is a second member 15 which is generally in the form of a housing detachably secured to the casting 11 by screws 16. A gasket 17 establishes a fluid-tight seal at the interface of the casting 11 and the housing 15.

Located within the housing 15 is a gear set 20 having a ring gear 21 and a pinion gear 22 identical to the gears of the pump of the aforementioned Hunsberger et al patent, the pinion being fixed to and rotatable with the free or inner end portion of the drive shaft 13. The ring gear is surrounded by a stationary spacer 23 which is sandwiched between the casting 11 and an end plate 24. Screws 25 secure the spacer 23 and the end plate 24 to the casting 11.

When the shaft 13 is driven, the pinion 22 of the gear set 20 is rotated and coacts with the ring gear 21 of the gear set to pressurize the fuel and to supply the pressurized fuel to an outlet or nozzle port 26 which is associated with the casting 11 and which is adapted to communicate with the oil burner. Fuel is delivered to the pump 10 by way of an inlet port 35 which is formed in the housing 15 on the side of the pump opposite the nozzle port 26 and which is connected to a supply line 36.

The pinion 22 is attached to the free or inner end portion of the shaft 13 in a manner which is somewhat similar but not identical to the attachment arrangement disclosed in Harwath U.S. Pat. No. 4,171,939. That is, the inner end portion of the shaft is formed with a radially and axially opening slot 38 which enables the pinion to be telescoped onto the shaft with a tight press fit but without splitting the pinion even though there is a wide range of tolerance variations between the shaft and the pinion.

Torque normally is transmitted between the shaft 13 and the pinion 22 by virtue of the press fit. In addition, however, key means coact between the shaft and the pinion to transmit torque if the pump 10 should require torque beyond the capability of the press fit.

Figure 3:
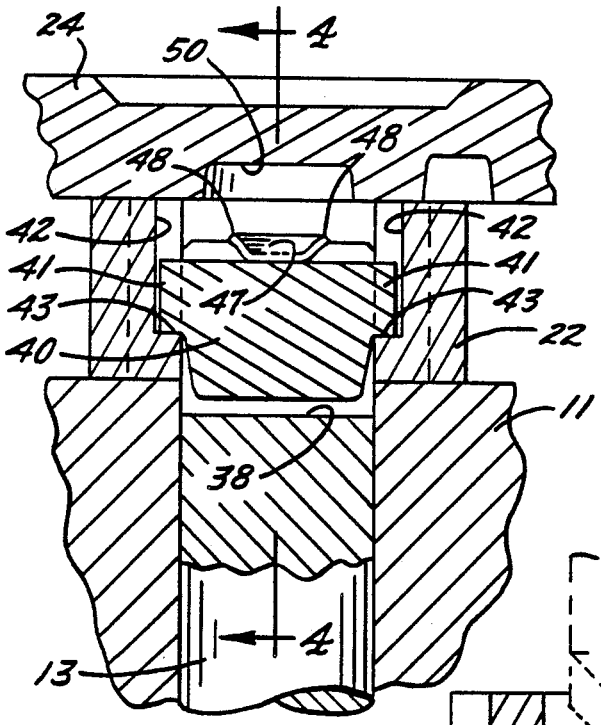
FIG. 3 is an enlarged view of certain parts shown in FIG. 1.
Figure 4:
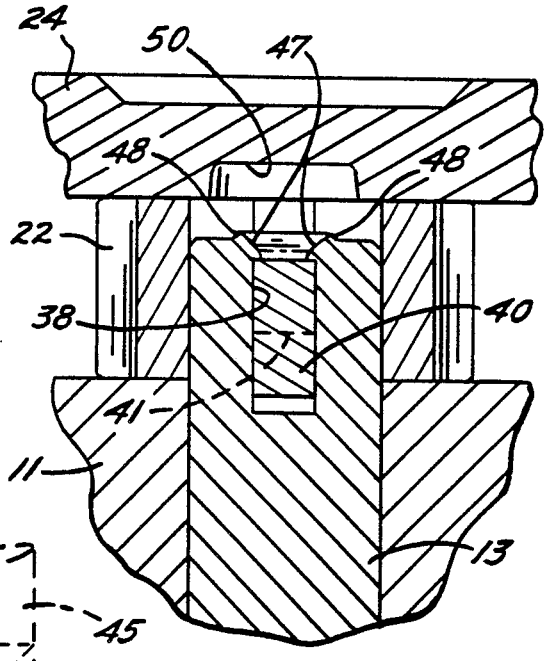
FIG. 4 is a fragmentary cross-section taken substantially along the line 4—4 of FIG. 3.

Specifically, the key means comprise a flat and generally T-shaped key 40 which is sized to fit in the slot 38 and which is formed with two ear portions 41 projecting radially outwardly from the shaft 13. As shown in FIG. 3, the ear portions extend into diametrically opposed slots or keyways 42 formed in the inner periphery of the pinion 22. The keyways open axially out of the inner end of the pinion and terminate as axially inwardly facing shoulders 43 located near the outer end of the pinion. The shoulders 43 engage the outer ends of the ear portions 41 of the key 40 and prevent the outer end of the key from bottoming against the slot 38.

Figure 5:
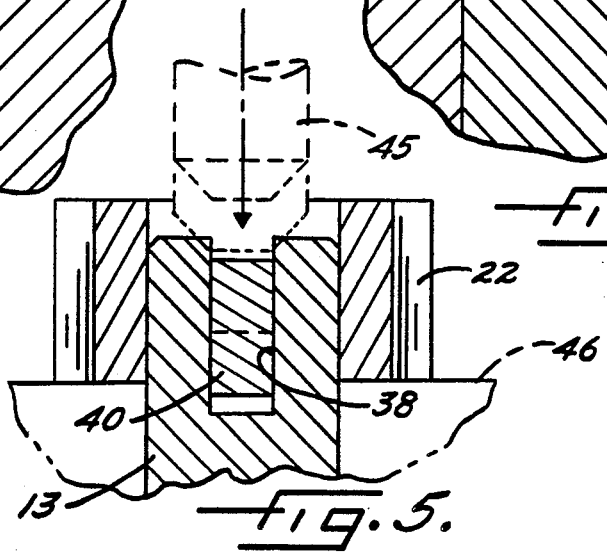
FIG. 5 is a view showing the end of the shaft being upset to hold the key in the shaft.

To assemble the pinion 22 to the shaft 13, the pinion is pressed onto the shaft while the key 40 is inside of the pinion, the key thus entering the slot 38 in the shaft. Thereafter, an electrode 45 is rammed downwardly against the center portion of the inner end of the shaft as shown in FIG. 5 while the shaft and the pinion are held by a fixture 46. The electrode swages the metal adjacent the end of the slot 38 over against the key 40 and forms a hot upset 47 to captivate the key in the slot and to augment the press fit in holding the pinion axially on the shaft. As a result of the electrode forming the upset, rather sharp burrs 48 project axially from the shaft in the vicinity of the upset.

In accordance with the present invention, a novel recess 50 is formed in the end plate 24 in opposing relation with the center portion of the inner end face of the shaft 13 and prevents the burrs 48 from embedding into the end plate and rotationally locking the shaft when the shaft is rammed forwardly with a force of significant magnitude. Herein, the recess 50 is circular in shape and has a diameter which is greater than the diameter of an imaginary circle inscribed by the burrs 48 but which is less than the outside diameter of the shaft. The recess is sufficiently deep to allow the burrs to enter the recess without bottoming against the recess when the outer peripheral portion of the end face of the shaft is in contact with the end plate 24.

Accordingly, if the shaft 13 is rammed inwardly by a significant axial force applied to the outer end of the shaft (for example, by dropping the pump 10), the outer peripheral portion of the inner end face of the shaft stops against the end plate 24 while the burrs 48 enter the recess 50 and stop short of the bottom of the recess. Thus, the shaft is free to rotate without the burrs restricting or preventing such rotation. As a result, the problem potentially presented by the burrs is eliminated without need of machining the burrs from the shaft and without need of welding a spacer washer or the like to the end plate 24. All that need be done is to form the simple recess 50 in the end plate when the latter is manufactured.

I claim:

1. A gear pump comprising a body, an elongated metal shaft rotatably supported by said body and having an axially facing free end, a pinion gear rotatable with the free end portion of said shaft, radially and axially opening slots in the gear and the free end of said shaft, a key in said slots preventing relative rotation between said shaft and said gear, an upset at the free end of said shaft near the center thereof and holding said key axially in said slots, an end plate connected to said body and normally disposed in spaced opposing relation with the free end of said shaft, and a recess in said end plate in opposing relation with the free end of said shaft and sufficiently large and deep to receive the center portion of the free end of said shaft in the event said shaft is pushed toward said end plate.

2. A gear pump as defined in claim 1 in which said shaft and said recess are generally circular in cross-section, said recess being coaxial with said shaft and being smaller in diameter than said shaft but larger in diameter than the upset metal at the center portion of said shaft.

3. A gear pump comprising a body, an elongated metal shaft of generally circular cross-section rotatably supported by said body and having an axially facing free end, a pinion gear rotatable with the free end portion of said shaft, radially and axially opening slots in the gear and the free end of said shaft, a key in said slots preventing relative rotation between said shaft and said gear, an upset at the free end of said shaft near the center thereof and holding said key axially in said slots, burr means resulting from said upset and protruding axially from the center portion of the free end of said shaft, an end plate connected to said body and normally disposed in spaced opposing relation with the free end of said shaft and with said burr means, and a generally circular recess in said end plate in opposing relation with the free end of said shaft, said recess being smaller in diameter than said shaft, being larger in diameter than an imaginary circle circumscribing said burr means and being sufficiently deep to receive said burr means without allowing the burr means to bottom against the recess when the free end of the shaft is pushed forward into contact with that portion of said end plate surrounding said recess.

* * * * *